US005239289A

United States Patent [19]

Ferraiolo et al.

[11] Patent Number: 5,239,289

[45] Date of Patent: Aug. 24, 1993

[54] TUNABLE INDUCTOR

[75] Inventors: Frank D. Ferraiolo, New Windsor; David P. Pagnani, Apalachin; Peter R. Tomaszewski, Roundtop, all of N.Y.

[73] Assignee: International Business Machines Corporation, Armonk, N.Y.

[21] Appl. No.: 754,856

[22] Filed: Sep. 4, 1991

[51] Int. Cl.[5] ..... H01F 27/28

[52] U.S. Cl. ..... 336/180; 324/656; 336/200; 336/232

[58] Field of Search ..... 336/232, 200, 137, 180, 336/144, 146, 145, 147; 324/656

[56] References Cited

U.S. PATENT DOCUMENTS

| | | | |
|---|---|---|---|
| 3,134,953 | 5/1964 | Eisler . | |
| 3,947,934 | 4/1976 | Olson | 29/25.42 |
| 4,035,695 | 7/1977 | Knutson et al. | 361/400 |
| 4,063,201 | 12/1977 | Komatsubara et al. | 333/70 R |
| 4,479,100 | 10/1984 | Moghe et al. | 336/200 |
| 4,494,100 | 1/1985 | Stengel et al. | 336/200 |
| 4,555,291 | 11/1985 | Tait et al. | 336/232 |
| 4,905,358 | 3/1990 | Einbinder | 29/25.42 |
| 4,926,292 | 5/1990 | Maple | 361/402 |

OTHER PUBLICATIONS

Askin et al., "Printed Inductor with Shorting Bars Deletable by Laser for Adjusting the Value of Inductance", IBM Technical Disclosure Bulletin, vol. 28, No. 7, Dec. 1985, pp. 3194–3195.

*Primary Examiner*—Thomas J. Kozma
*Attorney, Agent, or Firm*—Floyd A. Gonzalez; Robert L. Troike; David L. Adour

[57] ABSTRACT

A compact, wide range inductor capable of being trimmed to a desired frequency value, comprising at least two individually tunable inductive elements of different resolution, disposed upon an insulative support. The inductor is usually placed within a hybrid circuit and trimmed after component population.

12 Claims, 2 Drawing Sheets

TUNABLE INDUCTOR

BACKGROUND OF THE INVENTION

1. Field of the Invention

This invention relates generally to the field of inductors and more particularly to hybrid circuit tunable inductors.

2. Description of the Related Art

In the manufacture of electronic equipment inductors are often used. Particularly, the microelectronics manufacturing industry frequently uses them, therefore the miniaturization of such components is of critical importance. In many cases during manufacturing, a circuit must be assembled first and thereafter tested. If upon testing the circuit is not within operational or desired limits, component replacement is required. Such replacement is both time consuming and expensive.

In recent years variable and tunable inductors have been used in the manufacturing process. Such an inductor may be formed within a hybrid circuit (one wherein some of the components are formed by conductors on an insulator or substrate) or a separate adjustable inductor element can be used. The need for miniaturization and performance has made the separate adjustable inductor ineffective. Due to its miniaturization, the inductor formed within a hybrid circuit is usually capable of being tuned using a laser or electron beam to remove or alter the inductor.

These variable inductors are manufactured into a circuit and then tuned to within operational limits. There have been a number of basic ways of achieving this goal. Often a spiral shaped inductor or a ladder or "U" shaped inductor with parallel shorts is used. Both of these have been useful in the current art, and both are commercially and industrially feasible.

The spiral inductor is space efficient; for a given tunable range the inductor takes very little space. The drawback to the spiral inductor is that the breaching of shorts across the spiral segment produces results that are not precisely predictable and of coarse granularity; thus it is not finely tunable. Such inductors, if designed for precision, with many tunable shorts, are very difficult to manufacture and add significantly to the cost. When the inductor is designed and manufactured with a smaller number of shorts, the inductor is useful and cost effective for applications where a broad range of values must be accommodated and component space is critical. It is not useful for applications where precision is critical.

The ladder or "U" shaped inductor is useful where fine tuning is required but space is not a premium consideration. Its inductance can be varied by breaching a short across its vertical legs. Here, however, the variance is substantially predictable and correlates highly to the number of, and spacing of the rungs. While such an inductor is useful for applications where precision is mandated, the space required per unit change of inductance is much greater than that of the spiral inductor.

Thus, using either of the aforementioned techniques has serious limitations; the former in terms of tuning precision, and the latter in terms of size and space requirements.

SUMMARY OF THE INVENTION

In practicing the invention, an electronic circuit is formed by disposing a conductive strip upon an insulative substrate. Selected adjacent sections of the conductive strip are shorted together by disposing additional conductive strips upon the substrate, forming a tunable inductor. The tunable inductor being formed such that there are at least two separately tunable inductive elements. Other components may also be added to form the complete circuit.

The tuning of the aforementioned tunable inductor may be performed either before or after the population of the circuit components. In the preferred embodiment it is tuned after the circuit is otherwise complete and components are added. Once the circuit comprising the tunable inductor is formed, it is tested to determine its current value of inductance. The current value of inductance is subtracted from a target value of inductance to determine the desired increase in inductance. The element with the coarsest resolution which is not greater than the desired increase is selected. If an element is selected, the outermost short on that inductive element is breached. The circuit is again tested, an element selected, and a short breached until no element can be selected without causing the value of inductance to rise above the target value; thus producing a circuit tuned to within the available resolution of the target.

Another method of tuning the circuit is equally as precise and may also be utilized. This method relies upon knowing the minimum tunable range of each inductive element. Once the circuit comprising the tunable inductor is formed, it is tested to determine its current value of inductance. The current value of inductance is subtracted from a target value of inductance to determine the desired increase in inductance. An inductive element is selected which is the finest resolution element in which its minimum tunable range, plus the sum of the minimum tunable range of all finer resolution elements, if any, is greater than the desired increase; if the resolution of the element is less than the desired increase, the outermost short of said selected element is breached. The circuit is again tested, an element selected, and a short breached until no short can be breached without causing the value of inductance to rise above the target value; thus producing a circuit tuned to within the available resolution of the target.

The foregoing and other features and advantages of the invention will be more readily understood upon consideration of the following detailed description of the invention, taken in conjunction with the accompanying drawings.

DETAILED DESCRIPTION OF THE INVENTION

The word "spiral" as used herein is intended to include a broad class of shapes which exhibit a winding path beginning at a substantially centralized location, wherein each successive winding circumscribes the previous winding. This definition is intended to include shapes that are irregular but generally spiral.

The word "ladder" or "U", as used herein to denote the shape of an inductor, is intended to include a broad class of shapes in which there are two lines carrying electrical current in opposite directions between which there is a negative mutual inductance. Usually such lines are substantially parallel and connected at one end. Further, the variable inductor in this shape would have shorts interconnecting or bridging these two lines.

For the purpose of this description, a hierarchy of separately tunable inductive elements exists in the instant invention such that all such elements may be ordered beginning with the element having the greatest total range of tuning. If two or more elements have the same total range, they are ordered according to the size of the discrete change that may be made, larger first. If two or more elements are otherwise equivalent, ordering is arbitrary.

Within any tunable inductive element, only the outermost remaining short—the short closest to the entry of electrons into the element—is breached. The change that can be made by breaching any short is measured as the change made by breaching that short when it is the outermost remaining short.

Figure 1:
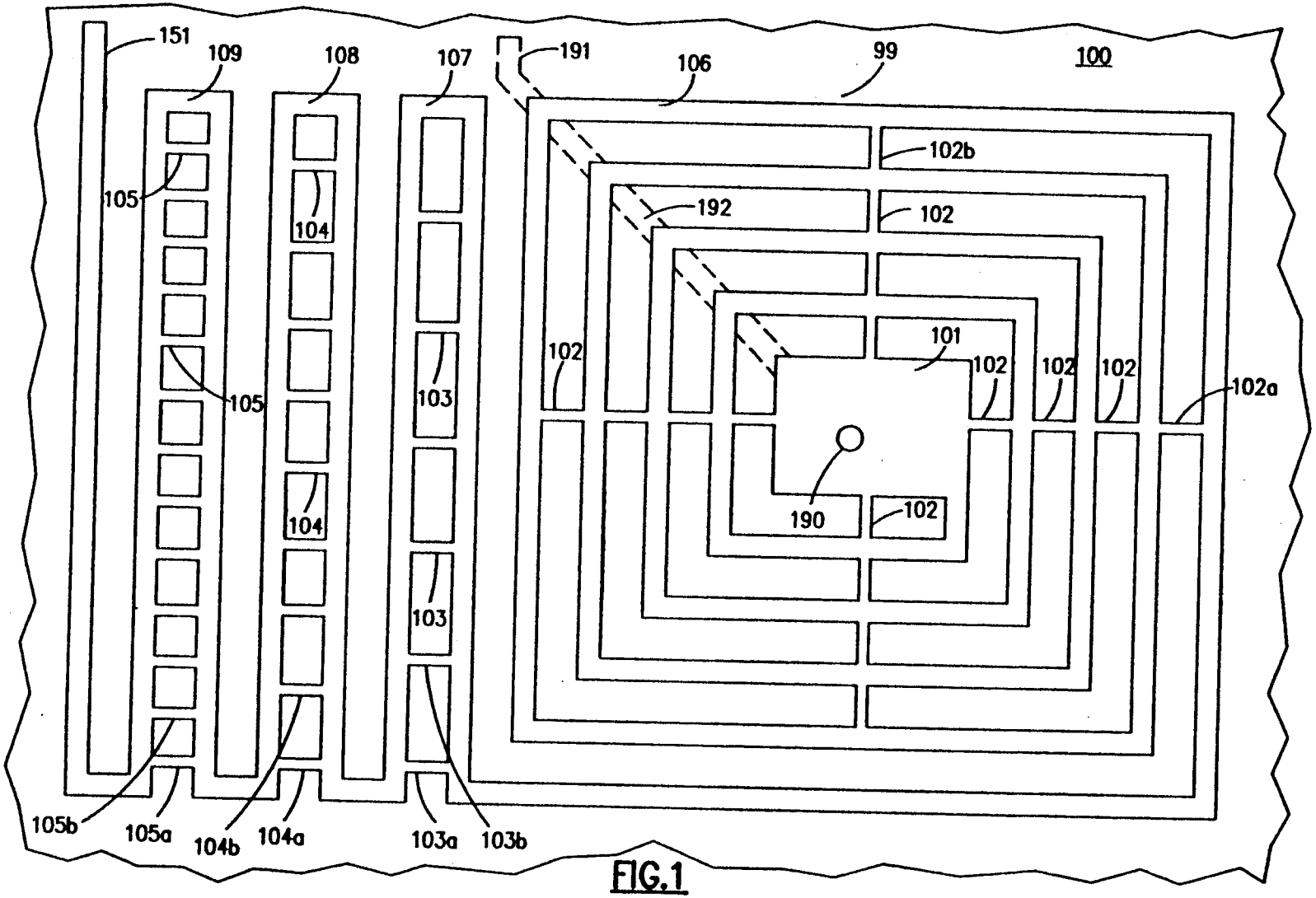
FIG. 1 illustrates a variable inductor, as a fragment of a circuit, in accordance with the present invention

FIG. 1 shows a substrate 100, which may be made of ceramic or of other suitable insulating material on which a conductor 99 is provided by any known method forming a spiral element 106 and ladder shaped elements 107, 108 and 109. The conductor 99 is attached at its ends 151 and 191, in-circuit to other components, usually disposed on or attached to the same substrate. The conductor 99 may be manufactured upon its own substrate and its ends attached to conductors upon another insulative support.

The spiral element 106 operates on the theory of a positive mutual inductance. The adjacent spiral winds of element 106 carry current flowing in the same direction which causes a positive mutual inductance. For a given length of wire, the spiral element will provide more inductance than a "U" shaped element or straight wire due to this positive or sympathetic mutual inductance.

The ladder elements 107, 108 and 109 also make effective use of mutual inductance, specifically negative mutual inductance. The ladder shaped elements 107, 108 and 109 have adjacent sides which carry current in opposing directions causing a negative mutual inductance. For a given length of wire, a ladder shaped element will provide less inductance than a spiral shaped element or a straight wire due to this negative mutual inductance.

Such mutual inductance is affected by the distance separating the current carrying elements, the closer the current carrying elements, the larger the positive or negative mutual inductance; conversely, the farther apart the current carrying elements, the lower the positive or negative mutual inductance.

Spiral 106 has an inner plate 101 connected through the substrate 100 by a conductive connector 190 to attach to a conductor 192 disposed on the back surface of the insulative support or on another adjoining insulative support.

Ladder element 107 has shorts 103 which form shortened conducting paths across the element. The outermost short 103*a* allows the majority of the current to flow directly across; as a result, the remaining shorts 103 will have relatively little effect since the majority of the current will flow through short 103*a*. Short 104*a* and short 105*a* have a similar effect upon ladder element 108 and ladder element 109 respectively. Once an outermost short 103*a*, 104*a* or 105*a* is severed, the inductance of the element will rise and the current will flow primarily through the next outermost short 103*b*, 104*b*, 105*b*.

Spiral element 106 has shorts 102 which form a conducting path to its center plate 101. The outermost short 102*a* allows the majority of current to flow through a sequence of shorts 102 directly to the center plate 101. The remaining shorts 102 will have relatively little effect since the majority of the current will flow through the short 102*a*. Once the outermost short 102*a* is severed the inductance of the element will rise and the current will flow primarily through the next outermost short 102*b*.

When the circuit, including the conductor 99 and the shorts 102, 103, 104 and 105 is assembled with other components to form a complete operable circuit it may thereafter be tested to determine its characteristics. The present invention contemplates the trimming of the shorts 102, 103, 104 and 105 sequentially to tune the complete operable circuit to the desired frequency. It is readily understood that the largest increase in inductance in each section may be achieved by breaching the outermost short 102*a*, 103*a*, 104*a* and 105*a* of a tunable inductive element. It is also readily understood that, due to mutual inductance, for any outermost short breached, the spiral element 106 will produce larger changes in inductance that the ladder elements 107, 108 and 109.

There should be no value of inductance within the range of the inductor which the instant inductor cannot be tuned to within its resolution. To accomplish this, the present invention is formed such that the largest tunable change that can be made in any element should be less than the total increase that can be made by all finer tunable elements. When selecting an inductor in accordance with the present invention, it is important to consider the resolution of such an inductor. The shorts 105 in the last tunable inductive element must be close enough together to obtain the target resolution.

Figure 2:
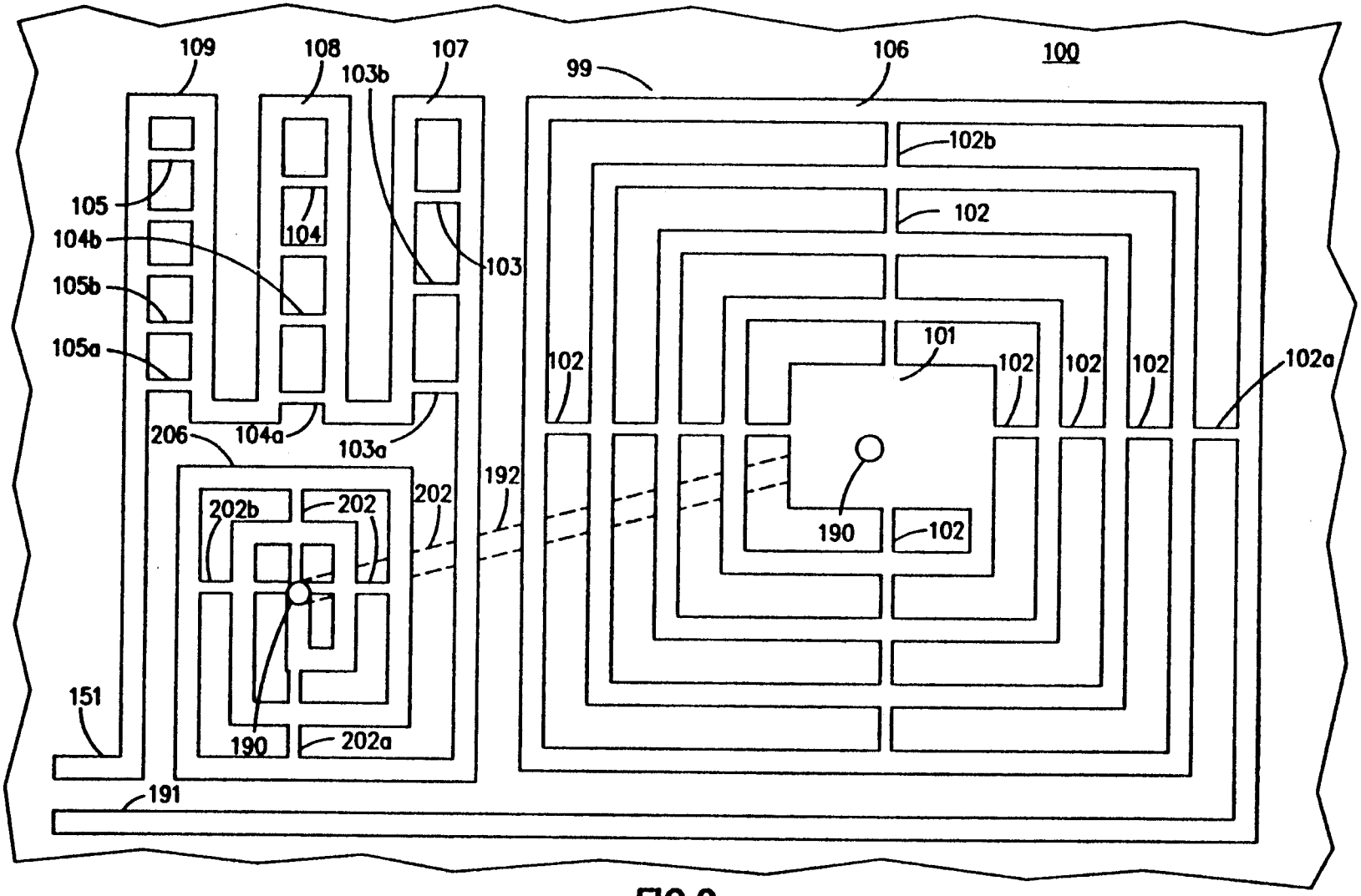
FIG. 2 illustrates another variable inductor, as a fragment of a circuit, in accordance with the present invention.

FIG. 2 shows another variable inductor, as a fragment of a circuit, in accordance with the present invention. Here, however, the inductor has two spiral elements 106 and 206 disposed upon a substrate 100. Unlike FIG. 1, terminals 151 and 191 both appear on the same surface of the substrate 100. The plate 101 is connected to conductor 192 by feed through connector 190. The conductor 192 is disposed on the back surface and is connected to the center of the spiral 206 by another feedthrough connector 190.

Producing a circuit tuned to a target (or desired) frequency can be performed using the tunable inductor illustrated in FIG. 1. The inductance of an inductor in a circuit is inversely related to the frequency of the circuit. By increasing the value of inductance a circuit will have a lower frequency; and by decreasing the value of an inductor a circuit will have a higher frequency.

Methods of producing a circuit tuned to a targeted frequency may utilize a circuit comprising a tunable inductor such as the tunable inductor represented in FIG. 1. Specifically, it is required that the tunable inductor must have at least two separately tunable inductive elements. A target for the value of inductance of the tunable inductor (and therefore the frequency of the circuit) must be known or selected. The maximum change in inductance for each inductive element due to the breaching of a short should additionally be known. It is also useful to know the minimum tunable range of each inductive element.

As a circuit is tuned, testing is required to determine the current value of inductance. Testing is performed prior to removal of any shorts and again each time one or more shorts are removed. After testing, the current value of inductance is subtracted from the target value to determine the desired increase in inductance.

In a first method, a short is selected for breaching by determining which unbreached short will produce the largest change in inductance that is not greater than the desired increase. The selected short is then breached. It is also possible, and often desirable, to breach a number of such shorts as long as the total increase in inductance will not be greater than the desired increase. The selected short or shorts are then breached.

Another method involves quite a different way of selecting a short for breaching. In this latter method, if the minimum range of the element with the finest resolution is greater than the desired increase, that element is selected. Otherwise, that minimum range is subtracted from the desired increase producing a remaining desired change, and the minimum range of the element with the next finest resolution is compared to the remaining desired change. If the minimum range of that element is greater than the remaining desired change, that element is selected. Otherwise, that minimum range is subtracted from the remaining desired increase; and so on until an element is selected. The outermost short of the selected element is breached if the maximum change is less than the desired increase (not the remaining desired increase). It is possible, and often desirable, to breach a number of such shorts in the selected element as long as the total increase in inductance will not be greater than the desired increase.

These methods are more easily understood by example. For simplicity, the numbers supplied are not actual data. A particular inductor, such as the inductor in FIG. 1, has four separately tunable inductive elements. Table 1 lists empirical data expressed in frequency (inversely related to the inductance of the tunable inductor) which is known for a particular tunable inductor.

TABLE 1

| | Minimum Range Khz | Maximum Change Khz | Number of Shorts |
|---|---|---|---|
| Spiral | 15000 | 2300 | 16 |
| Coarse | 920 | 210 | 6 |
| Medium | 920 | 110 | 9 |
| Fine | 920 | 70 | 13 |

The target value for the circuit is 19950 Khz.

By testing the circuit, the current value for the circuit is determined to be 29826 Mhz. By subtracting this from the target value we obtain a desired decrease in frequency (increase in inductance) of 9876 Khz.

In first tuning method, a short would be selected which will produce the largest change not greater than the desired decrease in frequency. The outermost short of the spiral meets this requirement because it produces a maximum of a 2300 Khz change (no other short has a larger change) and this change is no greater than the desired decrease in frequency of 9876 Khz. In the preferred embodiment, the outermost four shorts in the spiral element would be cut before subsequent testing. The maximum change that could be produced by this action is four times 2300 Khz, or 9200 Khz; and this is less than 9876 Khz, the desired decrease.

After the shorts are breached, the circuit is again tested and the current value is found to be 21732 Khz, and by subtracting the target value, the desired increase is found to be 1782 Kkz. Next, select a short which will produce the largest change not greater than the desired decrease in frequency. The short selected would be one of the coarse shorts as their maximum change is only 200 Khz, much less than the 1782 Khz remaining. Note that the spiral short must not be selected because its maximum change of 2300 Khz is greater than the desired decrease. While mathematically, eight of the shorts would be breached from the coarse element, there are only six, thus all six are to be breached. The maximum change that could be produced by this action is six times 200 Khz or 1200 Khz, well below the 1782 Khz remaining.

Testing now reveals a current value of 20645 Khz leaving a desired decrease of 695 Khz. Since there are no more coarse shorts, medium shorts have the largest change less than the desired inductance. Breaching the outermost five will yield a change of less than 695 Khz remaining, thus these are breached. This time, testing the circuit reveals 20156 Khz leaving a desired decrease of 206 Khz. One medium short may be breached. Testing after breaching that short yields 20067 Khz, or a desired decrease of 117 Khz. Only one fine short may be breached, leaving a current value of 20031 Khz and a desired decrease of 81 Khz afterwards. Again one fine short being breached the current value becomes 19988. Now the desired decrease is only 38 Khz.

As a final and optional step, once no more shorts have a largest change less than the desired decrease, the short with the smallest maximum change may now be breached if its maximum change is less than twice the desired decrease. In the example, a fine short remains, and its maximum change is 70 Khz, this is less than 76 Khz (two times 38 Khz, the desired decrease.) Thus this short is breached, and after testing the current (and final) value is 19940 Khz. This final value is within 10 Khz of the target.

In another method of tuning, an element would first be selected. The selected element must be the finest resolution element in which the minimum range, plus the minimum range of all elements of finer resolution, summed together are greater than the desired decrease. Starting with the same example, the circuit is tested and the current value is 29826 Khz, thus the desired decrease will be 9876 Khz. The spiral element will be chosen because the sum of the minimum range of all the elements of finer resolution is 2400 Khz (800 Khz+800 Khz+800 Khz) plus the minimum range of the spiral (15000 Khz) yields a total of 17400 Khz which is greater than the desired decrease. The four outermost shorts will be breached in the spiral (the selected element) because the maximum change this will yield is 9200 Khz, and this is below the desired decrease.

Testing shows an actual change of 8094 Khz to a current value of 21732 Khz, leaving a desired decrease of 1782 Khz. The next element selected is the coarse element because the sum of the minimum range of the coarse element, plus the sum of the minimum range of all elements of finer resolution is 2400 Khz, and this is sufficient to decrease the frequency by the desired decrease of 1782 Khz. As in the previous method, even though mathematically eight shorts should be selected, the physical limitation of six exists. Therefore all six of the shorts in the selected (coarse) element are breached. After testing the current value is 20645 Khz leaving a desired change of 695 Khz.

Since the fine element has a minimum tunable range of 800 Khz, more than sufficient to tune to the desired decrease of 695 Khz, it is the selected element. The outermost nine shorts of the finest element are breached (9 times 70 Khz being less than 695 Khz). And subsequent testing gives a current value of 20099 Khz, or a desired decrease of 149 Khz. The selected element is again the fine element, and two shorts are breached leaving a tested current value of 19968 Khz or a desired decrease of 18 Khz.

As a final and optional step, once no more shorts have a largest change less than the desired decrease, the short with the smallest maximum change may now be breached if its maximum change is less than twice the desired decrease. In the example, a fine short remains, and its maximum change is 70 Khz, this is not less than 36 Khz (two times 18 Khz, the desired decrease.) Thus this short is not breached, and the current (and final) value remains 19968 Khz. This final value is within 18 Khz of the target.

Even though the above examples demonstrate that the first method tuned the circuit closer to the target value, this is not the case. Both methods are equally capable of tuning the circuit to within one half of the maximum change of a short in the finest element.

Thus it can be seen that a new, improved, variable inductor that is compact and has a wide dynamic range for an inductor of its precision, and new, improved methods of tuning a circuit comprising a variable inductor have been provided by the present invention. The disclosed inductor is easily and precisely tunable to increase the inductance value thereof in a pre-assembly or post-assembly operation.

It will be understood that the invention may be embodied in other specific forms without departing from the spirit or central characteristics thereof. The instant examples and embodiments, therefore, are to be considered in all respects as illustrative and not restrictive, and the invention is not to be limited to the details given herein.

What is claimed is:

1. A tunable inductor tunable by means for severing conductive shorts comprising, in combination:

an insulative substrate;

at least two differently shaped separately tunable inductive tuning elements of different tuning resolution connected to each other, each tuning element comprising a conductive strip having adjacent sections disposed upon one surface of said substrate and having a plurality of conductive severable shorts disposed on said substrate between said adjacent sections of said conductive strip to provide tuning by said severing means.

2. An inductor as claimed in claim 1 wherein a first tuning element of said tuning elements with coarser resolution has a largest tunable short adjustment of less than the sum of all said elements with a finer resolution.

3. An inductor as claimed in claim 1 wherein said means for severing is a laser beam.

4. An inductor as claimed in claim 1 wherein there are a plurality of ladder shaped elements with the shorts being rungs on the ladder.

5. An inductor as claimed in claim 4 wherein said shorts are spaced closer in one ladder shaped element than in another ladder shaped element.

6. An inductor as claimed in claim 5 wherein said shorts are equidistantly spaced within all said ladder shaped elements.

7. A tunable inductor comprising:

an insulative substrate;

a conductive strip having adjacent sections disposed upon said substrate; said strip being in the form by at least one spiral configuration and linear configuration; and a plurality of severable shorts between said adjacent sections of said conductive strip forming a separately tunable spiral element and at least one separately tunable ladder shaped element.

8. An inductor as claimed in claim 7 wherein each tunable spiral element with coarser resolution has a largest tunable adjustment of less than the sum of all said ladder shaped elements with a finer resolution.

9. An inductor as claimed in claim 8 wherein said shorts are capable of being selectively severed by a laser beam.

10. An inductor as claimed in claim 8 wherein said plurality of shorts in said spiral element connect adjacent turns of said spiral element.

11. An inductor as claimed in claim 8 wherein there are a plurality of spiral elements.

12. An inductor as claimed in claim 11 wherein said shorts in said spiral elements are formed in substantially radial alignment with predetermined angular spacing.

* * * * *